US005586705A

United States Patent [19]

Leonard

[11] Patent Number: 5,586,705

[45] Date of Patent: Dec. 24, 1996

[54] RUCKSACK HARNESS

[75] Inventor: James Leonard, Dublin, Ireland

[73] Assignee: Lowe Alpine Systems International Limited, County Offaly, Ireland

[21] Appl. No.: 545,866

[22] PCT Filed: May 11, 1994

[86] PCT No.: PCT/IE94/00027

§ 371 Date: Nov. 13, 1995

§ 102(e) Date: Nov. 13, 1995

[87] PCT Pub. No.: WO94/26143

PCT Pub. Date: Nov. 24, 1994

[30] Foreign Application Priority Data

May 14, 1993 [IE] Ireland ..... S930368

[51] Int. Cl.[6] ..... A45F 3/04

[52] U.S. Cl. ..... 224/631; 224/627

[58] Field of Search ..... 224/627, 628, 224/631, 632, 633, 634, 637, 641, 645

[56] References Cited

U.S. PATENT DOCUMENTS 4,842,173 6/1989 Scherer .

FOREIGN PATENT DOCUMENTS

| | | | |
|---|---|---|---|
| 333610 | 9/1989 | European Pat. Off. | 224/213 |
| 526961 | 2/1993 | European Pat. Off. | 224/211 |
| 2670096 | 6/1992 | France | 224/211 |
| 2695016 | 3/1994 | France . | |
| 3045881 | 7/1982 | Germany . | |
| 9211744.9 | 1/1993 | Germany . | |
| 678796 | 11/1991 | Switzerland | 224/211 |
| 92/21265 | 12/1992 | WIPO . | |

*Primary Examiner*—Henry J. Recla
*Assistant Examiner*—Gregory M. Vidovich
*Attorney, Agent, or Firm*—Young & Thompson

[57] ABSTRACT

A height-adjustable carrying harness for a rucksack having a pair of shoulder straps connected together at a yoke. The yoke is engageable with a harness engaging system secured to the rear wall of the rucksack. The harness engaging system is comprised of a plurality of overlapping slat which define open ended sleeves into a selected one of which the yoke is inserted. The yoke is held in the sleeve by a tie strap which is fastened to a buckle located below the harness engaging system. The overlapping slats allow for fine height adjustment of the shoulder straps.

13 Claims, 7 Drawing Sheets

RUCKSACK HARNESS

TECHNICAL FIELD

The present invention relates to a rucksack harness and more particularly to rucksack harnesses of the type comprising a pair of shoulder straps joined together at a harness yoke, and having a tie strap which is threaded through a plurality of bands arranged in a ladder configuration on the body of a rucksack. The term "rucksack" as used throughout the description and claims is intended to include backpacks and other bags carried on the shoulder by means of a shoulder harness.

BACKGROUND ART

The ladder style construction of rucksack harness adjustment systems is well known. The best known of these systems is the PARALUX (Trade Mark) suspension system. Many modifications and variations of this system are currently available on the high grade rucksack and climbing equipment market. The PARALUX(™) system is known for its ruggedness, durability and stability in use. Some modifications of this system have similar performance to the PARALUX(™) system but usually comprise expensive alternative components.

In the PARALUX(™) suspension system a plurality of transverse webs are sewn in ladder-like fashion to the back wall of the rucksack. The shoulder straps terminate in a strap which is threaded through a selected one of the webs depending on the desired location of the shoulder straps. The strap is then threaded through a buckle and tightened, threaded under the next highest ladder web, through a web on the shoulder harness, and then threaded through a further ladder web.

The loose end of the strap is pushed down behind the ladder configuration. Finally, a top stabilizer web is threaded through buckles at the top of the ladder to stabilize the connection.

A known disadvantage of the ladder type adjustment system is its relative complexity. A rucksack owner may easily forget how to adjust the system to account for different loads or different users. Additionally, at points of sale, adjustment of a rucksack to fit a number of customers is time consuming and off-putting to both the customer and retailer.

As a result of the ladder configuration of the restraining bands, adjustment of the harness or harness yoke with respect to the rucksack may only be facilitated at a small number of adjustment positions along the ladder structure, usually one position approximately every 5 cm. Each rung of the ladder comprises a band of 2.5 cm wide strap with a similar spacing between each strap. Consequently, for a 30 cm adjustment ladder only six adjustment positions are available.

German Gebrauchsmuster No. G 92 11 744.9 discloses a rucksack comprising a backpack having at an upper region of the back wall two carrier straps which are height-adjustably secured to the back wall. A plurality of transverse loops or webs are stitched to the back wall of the backpack in spaced apart and ladder-like fashion. The shoulder straps are joined together by a harness yoke, and a plate attached to the yoke is inserted behind a selected loop and is locked in position by means of a snap fastener. The invention is concerned with the provision of a guide for the purpose of facilitating the positive guidance of the plate through the loops. The guide is in the form of a band of textile material which extends continuously over the height of the loops.

German Patent Application No. DE 3045881 discloses a height-adjustable system for attaching a carrying harness to a rucksack in which a number of transverse bands or webs are sewn to the rear wall of the rucksack to form a ladder-like configuration similar to the PARALUX(™) system described above. The transverse bands are sewn to the rear wall of the rucksack by means of stitches which extend in a v-shape, to provide for varying shoulder widths.

The arrangements described in the above German Gebrauchsmuster and patent application suffer from the same disadvantages as described above in relation to the PARALUX™system, namely that adjustment may be complicated for the user, and a fine adjustment is not readily obtainable.

Mechanical means are known for adjusting the height of the shoulder harness on rucksacks, typically in which the yoke connecting the shoulder harness slides in vertically arranged runners or tracks on the back wall of the rucksack, and is locked in place by a locking system. Known mechanical systems include the TORSO TRAC™ suspension system (U.S. Pat. No. 4,860,936), and the systems described, for example, in European Patent 0,173,024 and German Gebrauchsmuster No. G 87 16 869.3. While these mechanical systems offer a quick and easy method of height adjustment they are expensive to manufacture. Also there is a tendency for the yoke to slip, and the locking system can cause problems.

FR, A, 2 695 016 (LAFUMA) is a document published prior to the international filing date but later than the priority date claimed. This document discloses a rucksack harness having a pair of shoulder carrier straps joined together at one end at a harness yoke, and yoke engagement means attached to the rear wall of the rucksack. The yoke engagement means comprises a plurality of horizontal slats. A strap attached to the yoke is passed under selected slats, threaded upwardly behind the slats, to emerge adjacent the top of the slats, from where it is folded over, and attached by quick fastening means (e.g. VELCRO™ to the yoke. The horizontal slats are spaced apart at regular intervals in a vertical direction, and do not provide for fine adjustment.

OBJECT OF THE INVENTION

It is an object of the present invention to seek to alleviate the above disadvantages and to provide an improved harness system which is easy to use, and relatively inexpensive to manufacture.

SUMMARY OF THE INVENTION

Accordingly, the present invention provides a rucksack having an adjustable harness comprising a pair of shoulder carrier straps joined together at one end thereof at a harness yoke, and yoke engagement means comprising a plurality of slats attached to the rear wall of the rucksack which define a plurality of open-ended sleeves to receive the harness yoke in height-adjustable engagement characterised in that the slats are overlapping and define a plurality of overlapping open-ended sleeves, into a selected one of which sleeves the harness yoke may be inserted.

Preferably, the harness yoke has a tie strap connected thereto which is engageable with fastening means on the rucksack to retain the harness yoke in a sleeve.

Conveniently, each sleeve is open-ended only across a portion of its width to allow the tie strap to penetrate through the pocket to be tied at or near the base of the yoke engagement means or rucksack body.

Advantageously, each of the overlapped slats is reinforced by the other overlapping slat or slats. Consequently, improved strength and durability are provided. Suitably, the slats 25 are comprised of lengths of flexible webbing extending transversely of the rear wall of the rucksack and laid partly over each other in overlapping arrangement in the vertical direction, and sewn together and to the rear wall by means of lines of stitching.

Conveniently, the overlapping slats can be closely spaced to provide a relatively large density of yoke receiving sleeves. This construction provides a high degree of adjustability. For example, the degree of overlap can be in the range 25 to 75%, suitably about 50%.

A marker position is provided on the yoke for correct positioning of the yoke within a sleeve.

The present invention further provides a method of adjusting a harness of a rucksack, including the steps of:

threading a tie strap through one of a plurality of overlapping slats;

drawing a harness yoke into an open-ended sleeve by the slats by pulling downwardly on the tie strap; and fixing the tie strap at or near the base of the rucksack body.

The harness adjustment system of the invention has a number of advantages over known systems. The overlapping slats provide for close and fine height adjustment of the harness. The adjustment is easy and reliable, and quick to make.

BRIEF DESCRIPTION OF THE DRAWINGS

The invention will now be described more particularly with reference to the accompanying drawings which show, by way of example only, one embodiment of harness according to the invention. In the drawings.

DESCRIPTION OF THE PREFERRED EMBODIMENT

Figure 1:
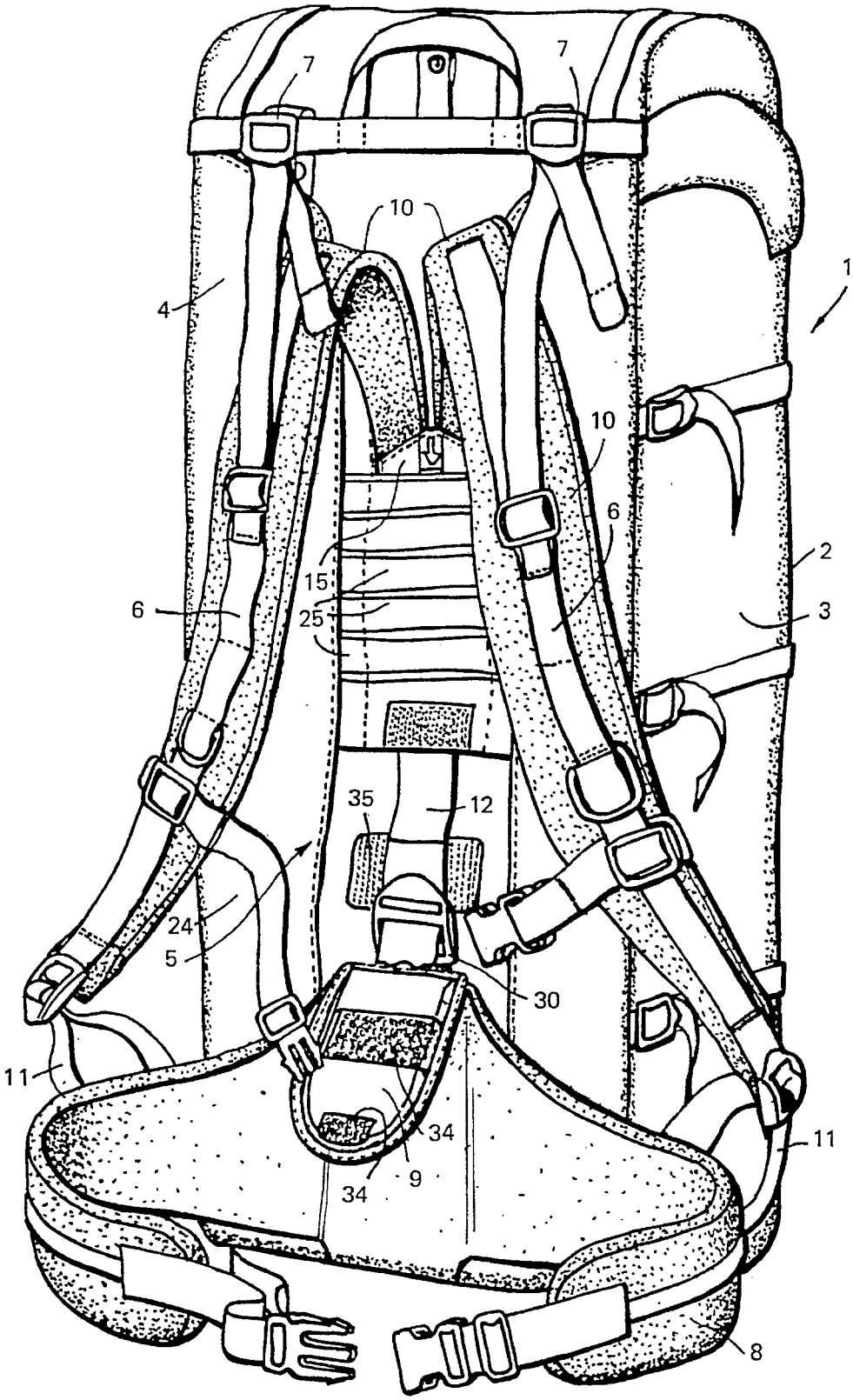
FIG. 1 is a perspective view of one embodiment of a shoulder harness of the invention attached to a rucksack.

FIG. 1 of the drawings shows a typical rucksack 1. The rucksack 1 has a front wall 2, side walls 3 and a rear wall 4. The rucksack is carried on the wearer's shoulders by means of a pair of shoulder straps 10 which are attached at their upper ends to the rucksack 1 by means of a harness engagement means 5 of the invention as hereinafter described. The harness engagement means 5 is sewn to the rear wall 4 of the rucksack 1. The harness engagement means 5 provides for a vertical adjustment of the point of attachment of the shoulder straps 10 to the body of the rucksack. The shoulder straps 10 are provided, in well known manner, with top stabiliser straps 6 which are adjustably connected to buckle 7 fixed to the top of the rear wall 4 of the rucksack. The rucksack is provided with a conventional waist belt 8 which is also attached to the rear wall 4 of the rucksack. The lower ends of the shoulder straps 10 are attached to the waistband 8 by adjustable straps 11. A hinge cover flap 9 is provided to cover the lower part of the harness engagement means, as described hereinafter.

Figure 2:
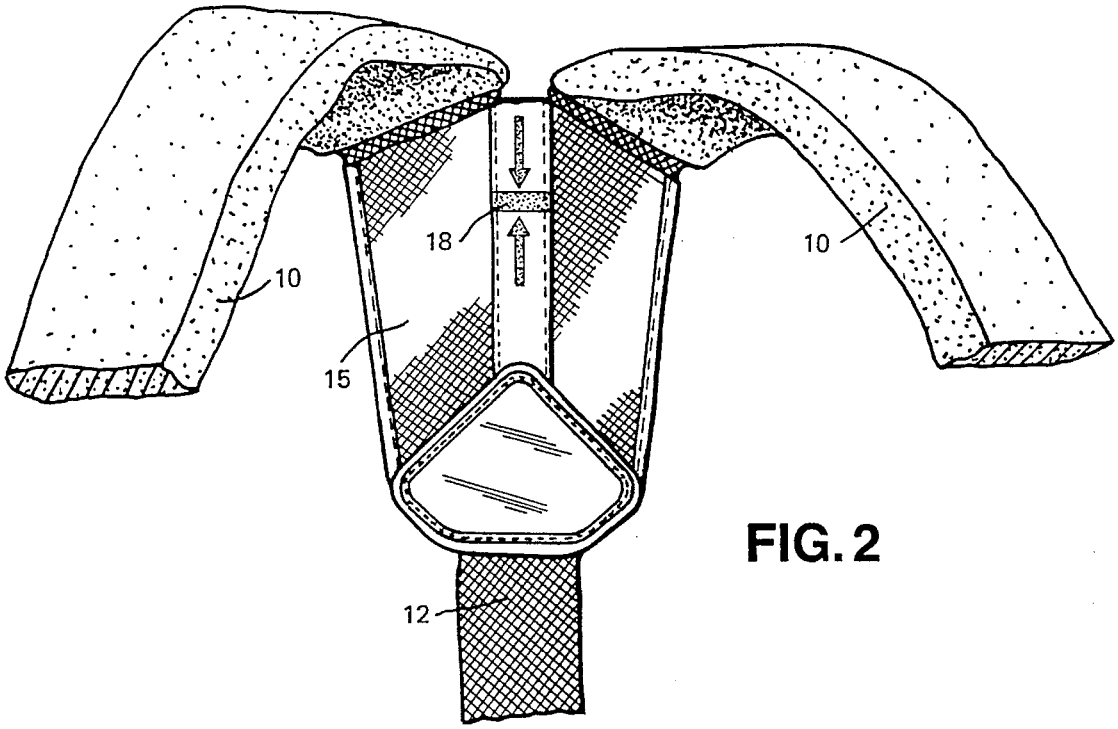
FIG. 2 is a perspective view of the harness shoulder straps connected at a harness yoke.

As shown in FIG. 2, the upper ends of the harness shoulder straps 10 are connected, by sewing, to a harness yoke 15 to define a Y-shape. The yoke 15 is essentially flat and has a tapering profile so that it is wedge-shaped. The narrow end of the yoke is connected to a tie strap 12. An indication marker 18 is provided on the yoke 15 to show the preferred depth of penetration of the yoke 15 into position in the harness engagement means.

The harness yoke engagement means is shown in more detail in FIGS. 3 to 8. The engagement means comprises a plurality of transverse slats 25 which are attached to the rear wall 4 of the rucksack in overlapping arrangement lengthwise of the rear wall 4. The slats 25 are comprised of lengths of flexible webbing material laid partly over each other in overlapping arrangement and are sewn to the rear wall 4 by lines of vertical stitching 14 (see FIGS. 5 and 7). To strengthen the construction, vertical reinforcing webs of material 16 are stitched over the lateral ends of the slat 25 by means of lines of stitching 17. The webs 16 also act as housings for metal frame members (not shown).

The slats 25 define open-ended sleeves (see FIG. 6 in particular) for receiving the harness yoke 15. Each slat 25 has an exposed leading edge 26 under which the tie strap 12 of the yoke 15 is inserted to place the yoke 15 in position. The first leading edge 28 is closed to prevent the yoke being inserted in this substantially unreinforced slat. The remaining slats 25 are reinforced by the overlapping construction of the slats 25, as described above.

Figure 5:
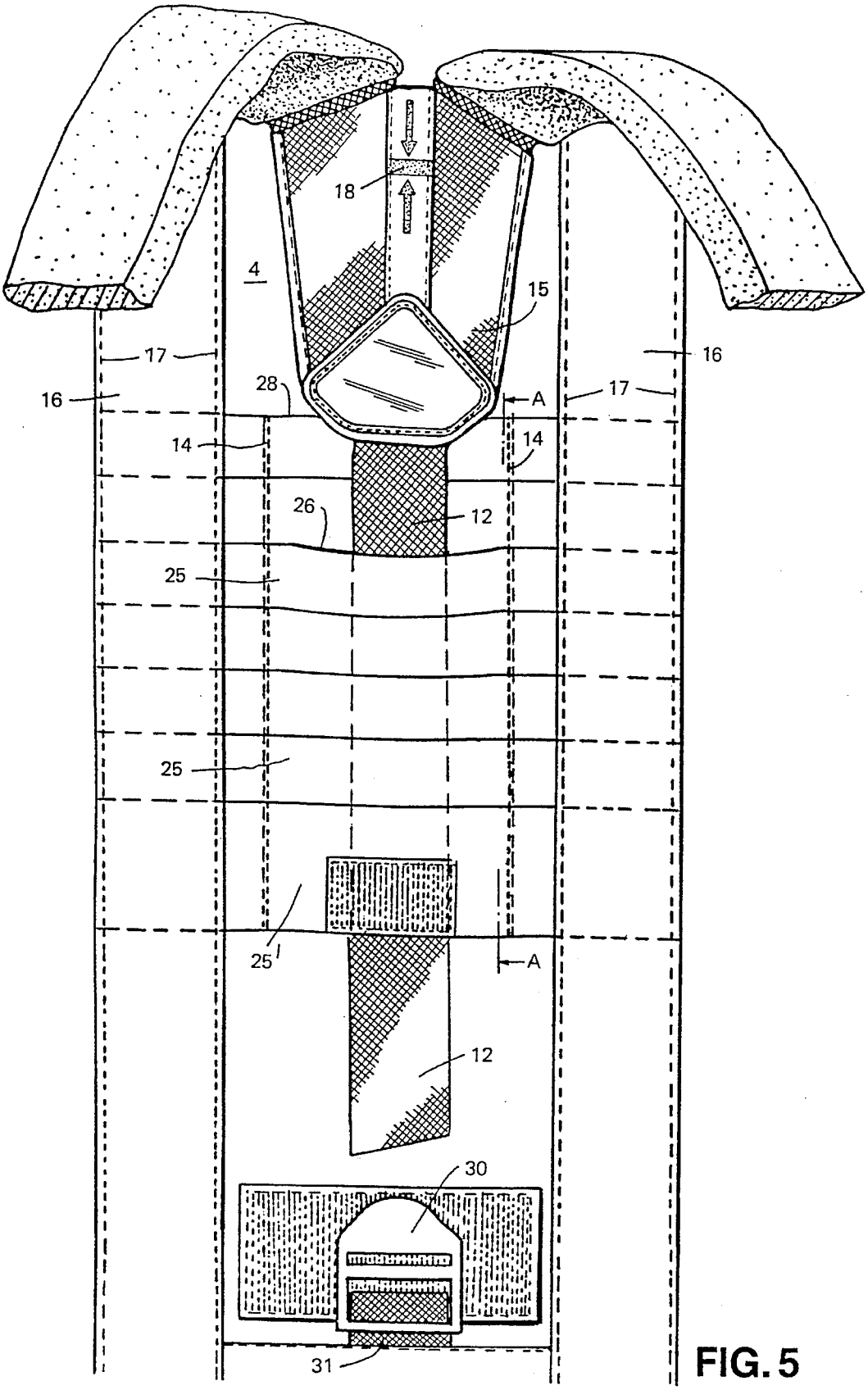
FIG. 5 is a plan view of portion of the rucksack harness of the invention showing the harness yoke about to be inserted in engagement means.
Figure 6:
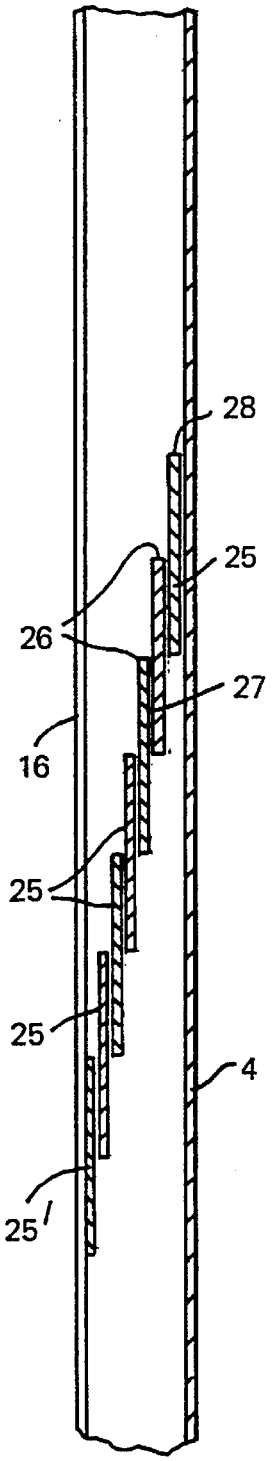
FIG. 6 is a sectional view on the line A—A of FIG. 5, the spacing between overlapping webs being exaggerated for clarity.
Figure 8:
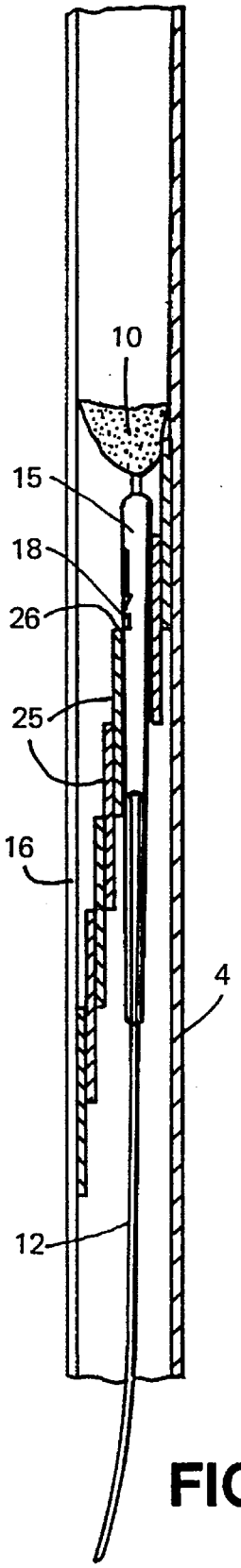
FIG. 8 is a sectional side view similar to FIG. 6, showing the harness yoke inserted.
Figure 7:
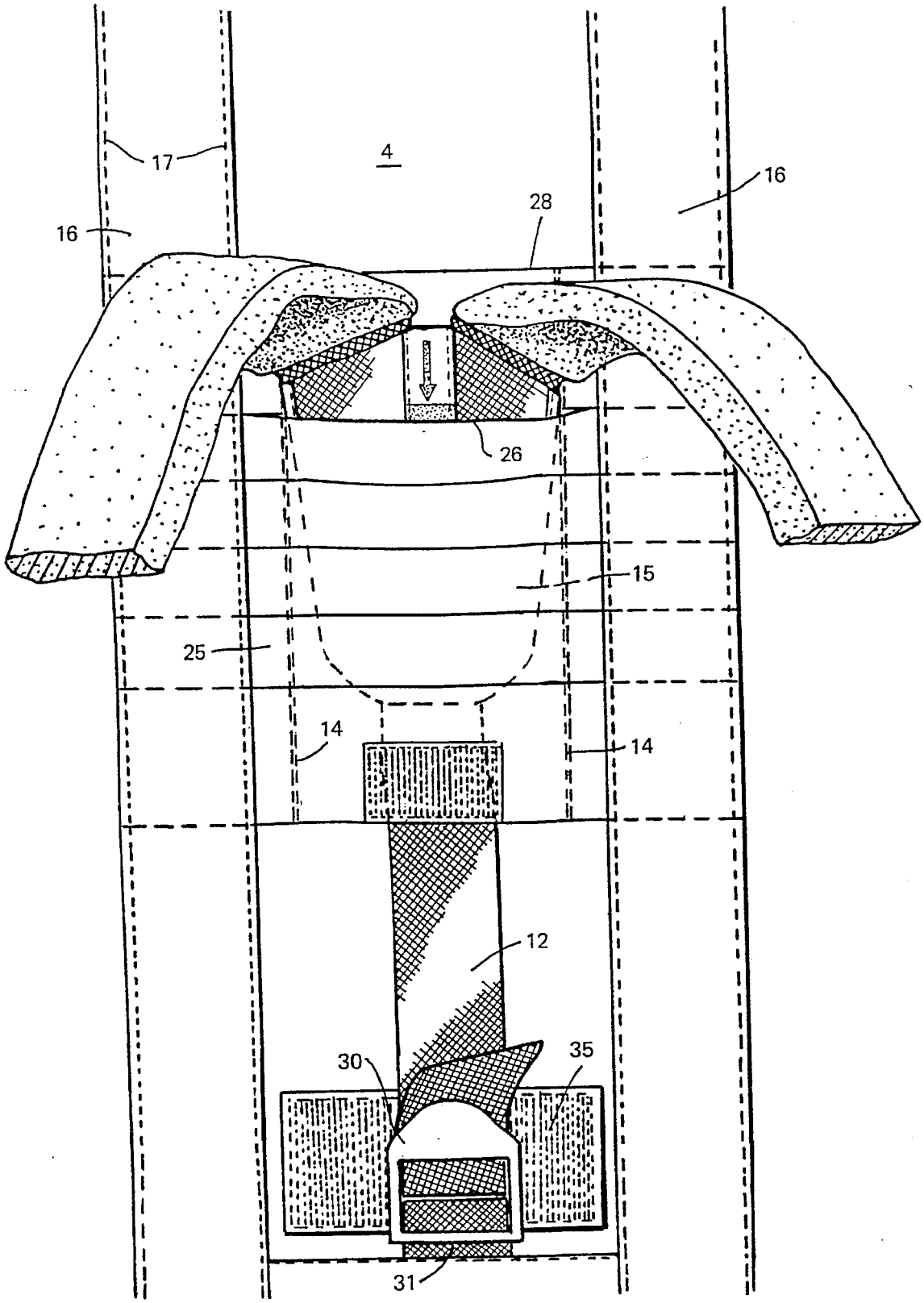
FIG. 7 is a plan view similar to FIG. 5 showing the harness yoke fully inserted.

In use, the tie strap 12 is inserted under the leading edge 26 of a selected one of the slats 25, as shown in FIG. 5. The tie strap 12 is threaded through the open-ended sleeve 27, and behind the lower slats, until it protrudes from the trailing edge of the lowest slat 25'. The tie strap 12 is pulled until the yoke 15 is securely drawn under the appropriate slat 25 to align the indication marker 18 on the yoke 15 with the leading edge 26 of the overlapping slat 25 (see FIG. 7).

Corresponding markers (not shown) are provided on the slats 25. Because of the wedge-shaped tapering profile of the yoke 15, the yoke 15 wedges in this position in the sleeve 27 and is prevented from moving further downwardly. Locking means are provided to lock the yoke 15 in position in the sleeve 27 against upward movement. This comprises the tie strap 12, the end of which engages in a buckle 30 located below the yoke engagement means. The buckle 30 is fastened to the rear wall 4 of the rucksack by means of a short strap 31.

Figure 3:
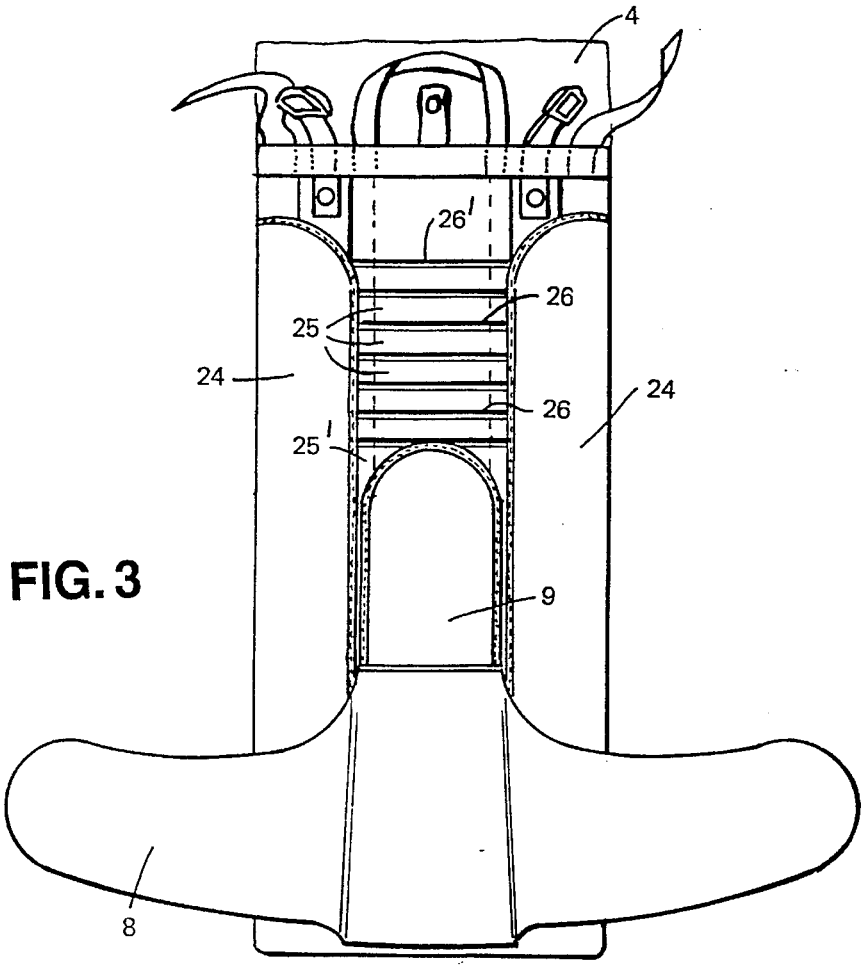
FIG. 3 is a plan view of a harness yoke engagement means attached to the rear wall of a rucksack.
Figure 4:
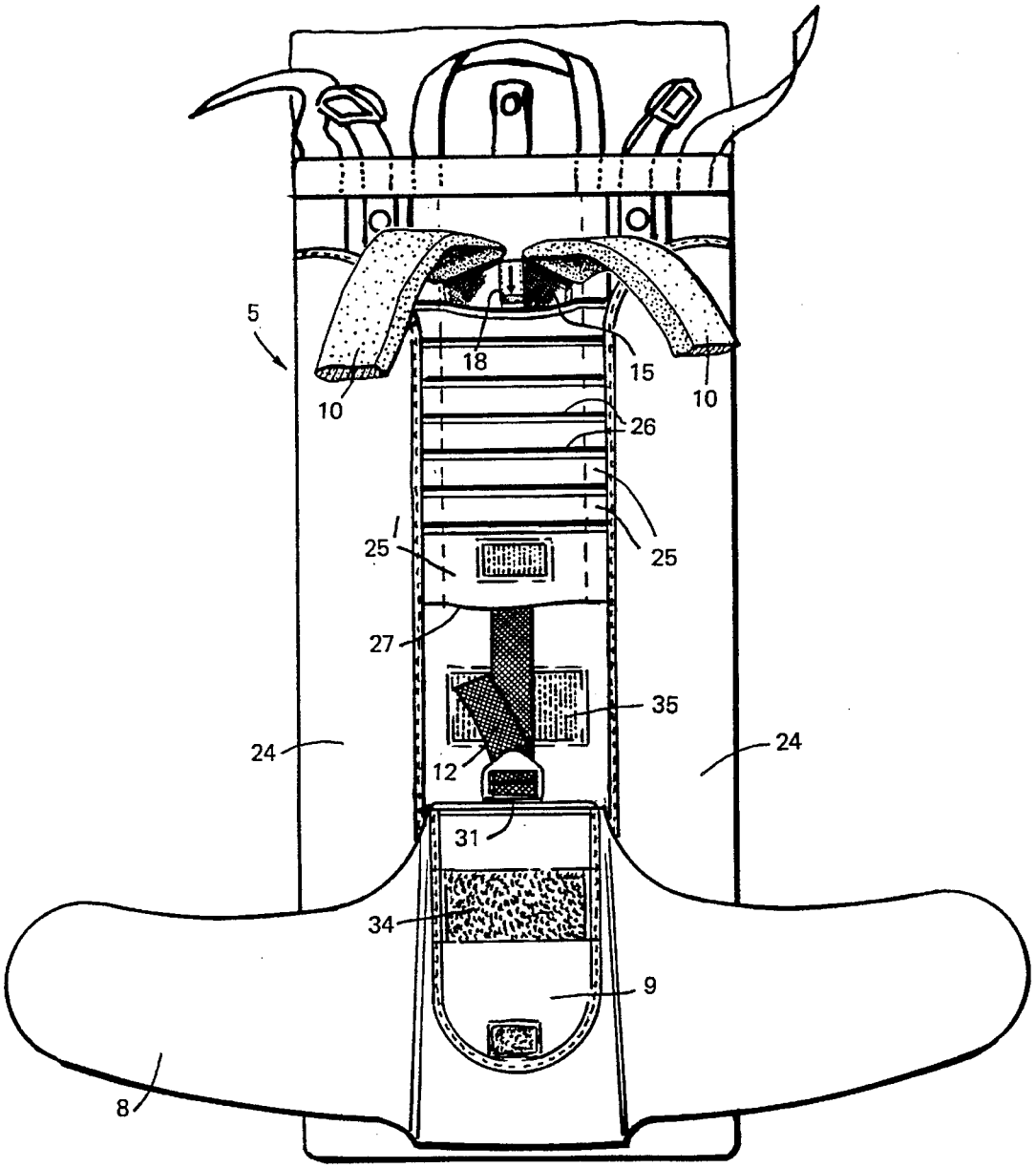
FIG. 4 is a perspective view of a rucksack harness with harness yoke in place ready for use.

As shown in FIGS. 1 and 4, the buckle 30 is covered by means of the hinged flap 9. The flap 9 is made from a cushioning material and-may be held in position over the buckle 30 by means of pads 34 of VELCRO(™) or like fastening material. The pad 34 engages with complementary pads 35 stitched to the rear wall 4 of the rucksack. An additional cushioning pad 34 may be provided adjacent the harness engagement means and also on the lowest slat 25' as shown in FIGS. 3 and 4.

To adjust the shoulder harness height, a user, or shop assistant for example, exposes the tie strap fixing location by pivoting the flap 9 outwardly, unlocking the tie strap 12 from the buckle 30 and slides the harness yoke 15 out of the sleeve 27 formed by the slat 25 by pulling on the shoulder straps 10. The yoke 15 is then relocated in another sleeve 27 by threading the tie strap 12 under the leading edge 26 of the respective slat 25. This operation is easily repeatable and does not require great skill or knowledge of rucksack harnesses.

It will be seen that the number of adjustment positions is dependent on the overlap and/or the number of the slats 25, The degree of overlap does not however affect the performance or the ease of use of the harness system, In the embodiment shown: each slat has a width (in the vertical direction) of 50 mm and the overlap is 25 mm, giving six adjustment positions over a 20 cm long slat portion, Thus, in this embodiment the rate of overlap is 50%. It will be appreciated that the degree of overlap defines the fineness of height adjustment of the harness; the greater the degree of overlap the finer the adjustment. Also the longer the slat portion of the yoke engagement means is in the vertical direction the greater the adjustment achieved. For example, the number of slats 25 may be increased to provide up to fifteen adjustment positions over a 30 cm long slat portion. To increase the speed of adjustment the buckle 30 may be substituted by a slim profile self-locking fastener, or similar device.

Figure 9:
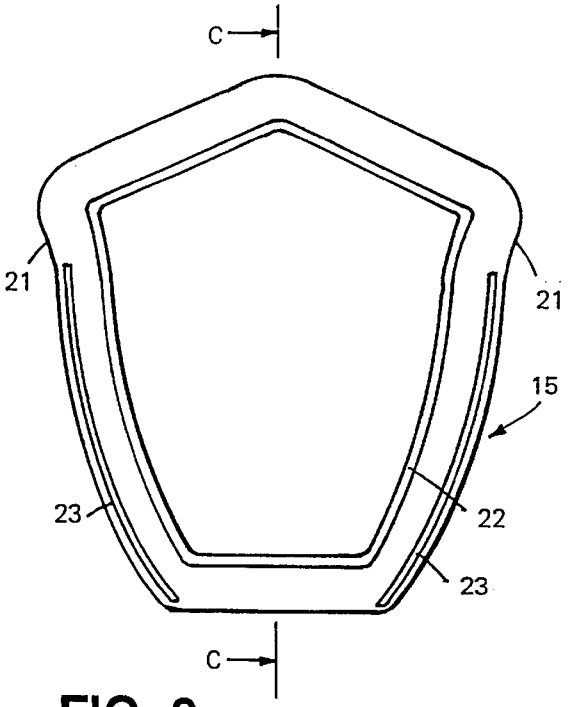
FIG. 9 is a plan view of a second embodiment of harness yoke.
Figure 10:
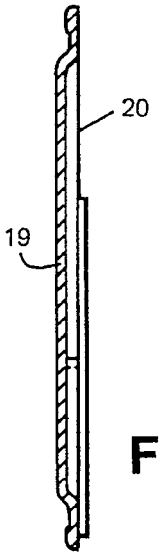
FIG. 10 is a section on the line c—c of FIG. 9.
Figure 11:
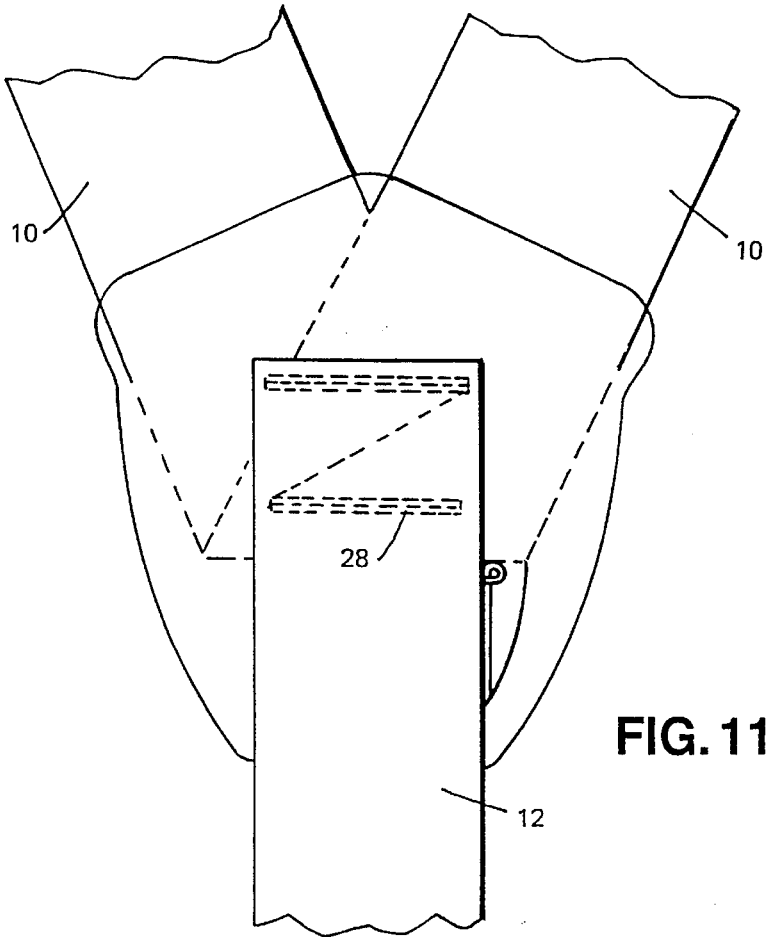
FIG. 11 is a rear elevation of the yoke of FIG. 9 with back wall removed showing attachment of harness straps.

An alternative version of the yoke 15 is illustrated in FIGS. 9 to 11. As shown in FIGS. 9 and 10, the yoke 15 is comprised of a front plate 19 which is spaced from but peripherally connected to a rear plate 20. The profile of the yoke is shown in FIG. 9 and it will be noted that it is wedge-shaped with a tapering profile; the top portion being wider than the bottom portion. The top portion is provided with shoulders 21 which, when the yoke 15 is inserted in respective sleeve, engage with the leading edges 26 of the sleeves 27, so as to prevent further downward movement of the yoke 15 in the sleeve 27. The arrangement for attaching the webs comprising the shoulder strap 10 and the tie strap 12 is illustrated in FIG. 11. The straps are placed over the inner face of the rear plate 20 as shown in FIG. 11 and are stitched together by means of stitching 28. The cover plate 19 is then placed over the webs and the plates 19, 20 are drawn together by stitching through stitching channels 22, 23. The resultant yoke is quite rigid.

The yoke 15 may be made from a suitable elastomeric material. For example, the rear plate 20 of the yoke 15 made from a high density polyethylene material to provide stiffness. The cover may be of 500 denier nylon.

The webbing material from which the slats 25 are manufactured, may be polypropylene, or polyester nylon, of a thickness of from 0.5 to 2 mm.

It will of course be understood that the invention is not limited to the specific details described herein, which are given by way of example only, and that various modifications and alterations are possible within the scope of the invention.

Where technical features mentioned in any claim are followed by reference signs, these reference signs have been included for the sole purpose of increasing the intelligibility of the claims and accordingly, such reference signs to not have any limiting effect on the scope of each element identified by way of example by such reference signs.

I claim:

1. A rucksack having a carrying harness, the carrying harness comprising:

two shoulder carrier straps connected at one end thereof to the rucksack;

a harness yoke to which the other ends of the shoulder straps are joined, and yoke engagement means on the rear wall of the rucksack to receive the harness yoke in height-adjustable engagement;

wherein the yoke engagement means comprises a plurality of overlapping transverse slats attached to the rear wall of the rucksack which define a plurality of overlapping open-ended sleeves into a selected one of which sleeves the harness yoke may be inserted.

2. A rucksack as claimed in claim 1, including retaining means for retaining the harness yoke in a selected one of said sleeves.

3. A rucksack as claimed in claim 2, wherein the retaining means comprises a tie strap connected at an upper end to the harness yoke and which is engageable at its other end with fastening means on the rucksack to retain the harness yoke in one of said sleeves.

4. A rucksack as claimed in claim 1, wherein the slats are comprised of lengths of flexible webbing extending transversely of the rear wall of the rucksack and are laid partly over each other in overlapping arrangement in the vertical direction, and are sewn together and to the rear wall of the rucksack by means of lines of stitching.

5. A rucksack as claimed in claim 1, wherein the degree of overlap of the slats is about 50%.

6. A rucksack as claimed in claim 3, wherein the tie strap connected to the yoke passes through one of said sleeves when the yoke is engaged in that sleeve and is connectible to the fastening means located below the yoke engagement means.

7. A rucksack as claimed in claim 1, wherein the yoke has a widened portion which prevents downward movement of the yoke in the sleeve beyond a predetermined depth.

8. A rucksack as claimed in claim 6, wherein the yoke is provided with indicator means which indicate the preferred depth of penetration of the yoke into the sleeve.

9. A rucksack as claimed in claim 4, wherein vertical reinforcing webs are stitched over the lateral ends of the slats, and are adapted to form housings for accommodating frame members of the rucksack.

10. A rucksack as claimed in claim 3, wherein the fastening means comprises a buckle attached to the rear wall of the rucksack and engageable with said tie strap.

11. A rucksack as claimed in claim 10, wherein a flap of cushioning material is hingedly attached to the rear wall of the rucksack and is adapted, in a closed position, to cover said buckle.

12. A rucksack having a carrying harness, the carrying harness comprising:

two shoulder carrier straps connected at one end thereof to the rucksack;

a harness yoke to which the other ends of the shoulder straps are joined, yoke engagement means on the rear wall of the rucksack to receive the harness yoke in height-adjustable engagement;

the yoke engagement means comprising a plurality of overlapping transverse slats attached to the rear wall of the rucksack which define a plurality of overlapping open-ended sleeves into a selected one of which sleeves the harness yoke may be inserted;

engagement means which prevents downward movement of the yoke in a selected sleeve beyond a predetermined depth; and retaining means for retaining the yoke in said selected sleeve.

13. A rucksack as claimed in claim 12, wherein the retaining means comprises a tie strap connected at an upper end to the harness yoke and which is engageable at its other end with fastening means on the rucksack to retain the harness yoke in a selected one of said sleeves.

* * * * *